US009818281B2

(12) United States Patent
Narasimhan

(10) Patent No.: US 9,818,281 B2
(45) **Date of Patent: *Nov. 14, 2017**

(54) METHOD AND SYSTEM FOR FALL DETECTION OF A USER

(75) Inventor: Ravi Narasimhan, Sunnyvale, CA (US)

(73) Assignee: Vital Connect, Inc., San Jose, CA (US)

( * ) Notice: Subject to any disclaimer, the term of this patent is extended or adjusted under 35 U.S.C. 154(b) by 232 days.

This patent is subject to a terminal disclaimer.

(21) Appl. No.: 13/296,139

(22) Filed: Nov. 14, 2011

(65) Prior Publication Data

US 2013/0120152 A1 May 16, 2013

(51) Int. Cl.
*G08B 21/00* (2006.01)
*G08B 21/04* (2006.01)

(52) U.S. Cl.
CPC ..... *G08B 21/043* (2013.01); *G08B 21/0446* (2013.01)

(58) Field of Classification Search
CPC .. G08B 21/043; G08B 21/0446; G08B 21/02; A61B 5/1117; A61B 5/725; G01P 15/00; G01P 15/0891
USPC ..... 340/669, 984
See application file for complete search history.

(56) References Cited

U.S. PATENT DOCUMENTS 8,092,398 B2 1/2012 Weinberg et al.
8,460,197 B1 * 6/2013 Brady ..... A61B 5/1118 600/485
9,005,141 B1 * 4/2015 Najafi ..... 600/587
2003/0076792 A1 4/2003 Theimer
2005/0067816 A1 3/2005 Buckman
2005/0093709 A1 * 5/2005 Franco ..... A61B 5/1112 340/686.1
2006/0001545 A1 1/2006 Wolf
2006/0010340 A1 1/2006 Makela et al.
2006/0149338 A1 7/2006 Flaherty et al.
2006/0268447 A1 11/2006 Liao et al.
2007/0073132 A1 3/2007 Vosch
2007/0073178 A1 * 3/2007 Browning ..... A61B 5/0022 600/519
2008/0146994 A1 6/2008 Gerber
(Continued)

OTHER PUBLICATIONS

PCT International Search Report and Written Opinion of the International Searching Authority, dated Mar. 28, 2013, application No. PCT/US2012/064858.

(Continued)

*Primary Examiner* — Naomi Small
(74) *Attorney, Agent, or Firm* — Brundidge & Stanger, P.C.

(57) ABSTRACT

A method, system, and computer-readable medium for fall detection of a user are disclosed. In a first aspect, the method comprises determining whether first or second magnitude thresholds are satisfied. If the first or second magnitude thresholds are satisfied, the method includes determining whether an acceleration vector of the user is at a predetermined angle to a calibration vector. In a second aspect, the system comprises a processing system and an application that is executed by the processing system. The application determines whether first or second magnitude thresholds are satisfied. If the first or second magnitude thresholds are satisfied, the application determines whether an acceleration vector of the user is at a predetermined angle to a calibration vector.

17 Claims, 4 Drawing Sheets

(56) References Cited

U.S. PATENT DOCUMENTS

| | | | | |
|---|---|---|---|---|
| 2008/0174444 | A1 | 7/2008 | Noda et al. | |
| 2009/0021858 | A1* | 1/2009 | Fu | G11B 5/5582 360/99.01 |
| 2009/0048540 | A1* | 2/2009 | Otto | A61B 5/1118 600/595 |
| 2009/0121863 | A1 | 5/2009 | Prior | |
| 2009/0187370 | A1* | 7/2009 | Pasolini | G01P 1/006 702/141 |
| 2009/0254003 | A1 | 10/2009 | Buckman | |
| 2010/0052896 | A1 | 3/2010 | Goodman | |
| 2010/0121226 | A1 | 5/2010 | Ten Kate et al. | |
| 2010/0121603 | A1 | 5/2010 | Nyan et al. | |
| 2010/0179389 | A1 | 7/2010 | Moroney, III et al. | |
| 2010/0228103 | A1 | 9/2010 | Schecter | |
| 2010/0268304 | A1 | 10/2010 | Matos | |
| 2010/0316253 | A1 | 12/2010 | Yang et al. | |
| 2011/0144542 | A1 | 6/2011 | Jin et al. | |
| 2011/0161111 | A1 | 6/2011 | Dicks et al. | |
| 2011/0199216 | A1 | 8/2011 | Flinsenberg et al. | |
| 2012/0075109 | A1* | 3/2012 | Wang | G01C 21/165 340/686.1 |
| 2012/0092156 | A1 | 4/2012 | Tran | |
| 2012/0095722 | A1* | 4/2012 | Ten Kate | A61B 5/1117 702/141 |
| 2013/0031373 | A1* | 1/2013 | Shang | G06F 21/10 713/189 |
| 2013/0054180 | A1* | 2/2013 | Barfield | G01P 15/0891 702/138 |

OTHER PUBLICATIONS

A.K. Bourke, et al., "Evaluation of a threshold-based tri-axial accelerometer fall detection algorithm", Gait & Posture 26 (2007), pp. 194-199.

M. Kangas, et al., "Determination of simple thresholds for accelerometry-based parameters for fall detection", Proceedings of the 29th Annual International Conference of the IEEE EMBS, Aug. 23-26, 2007, pp. 1367-1370.

* cited by examiner

METHOD AND SYSTEM FOR FALL DETECTION OF A USER

FIELD OF THE INVENTION

The present invention relates to wireless sensor devices, and more particularly, to using a wireless sensor device to detect a user's fall.

BACKGROUND

Wireless sensor devices are used in a variety of applications including the health monitoring of users. In many of these health monitoring applications, a wireless sensor device is attached directly to the user's skin to measure certain data. This measured data can then be utilized for a variety of health related applications. In one instance, this measured data can be utilized to assist in detecting when a user has fallen due to a health related disease or external factor and is injured as a result.

Conventional approaches have detected when a user has fallen by measuring acceleration data related to the fall and comparing that data to various thresholds. However, these conventional approaches fail to discriminate problematic falls from activities of daily living, such as falling onto a couch to take a nap, and require that the wireless sensor device be attached to the user in specific orientations.

These issues limit the fall detection capabilities of wireless sensor devices. Therefore, there is a strong need for a cost-effective solution that overcomes the above issues by creating a method and system for a more accurate fall detection of a user without having to attach the wireless sensor device to the user in a specific and known orientation. The present invention addresses such a need.

SUMMARY OF THE INVENTION

A method, system, and computer-readable medium for fall detection of a user are disclosed. In a first aspect, the method comprises determining whether first or second magnitude thresholds are satisfied. If the first or second magnitude thresholds are satisfied, the method includes determining whether an acceleration vector of the user is at a predetermined angle to a calibration vector.

In a second aspect, the system comprises a processing system and an application that is executed by the processing system. The application determines whether first or second magnitude thresholds are satisfied. If the first or second magnitude thresholds are satisfied, the application determines whether an acceleration vector of the user is at a predetermined angle to a calibration vector.

BRIEF DESCRIPTION OF THE DRAWINGS

The accompanying figures illustrate several embodiments of the invention and, together with the description, serve to explain the principles of the invention. One of ordinary skill in the art will recognize that the particular embodiments illustrated in the figures are merely exemplary, and are not intended to limit the scope of the present invention.

DETAILED DESCRIPTION OF PREFERRED EMBODIMENTS

The present invention relates to wireless sensor devices, and more particularly, to using a wireless sensor device to detect a user's fall. The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiments shown but is to be accorded the widest scope consistent with the principles and features described herein.

A method and system in accordance with the present invention allows for fall detection of a user. By implementing a wireless sensor device, an efficient and cost-effective fall detection system is achieved that can discriminate problematic falls from activities of daily living and is accurate regardless of the attachment orientation of the wireless sensor device to the user. One of ordinary skill in the art readily recognizes that a variety of wireless sensor devices may be utilized and that would be within the spirit and scope of the present invention.

To describe the features of the present invention in more detail, refer now to the following description in conjunction with the accompanying Figures.

In one embodiment, a wireless sensor device is attached to a user and continuously and automatically obtains data including but not limited to acceleration samples of the user. An application embedded within a processor of the wireless sensor device compares the acceleration samples to a lower acceleration magnitude threshold or to a higher magnitude threshold and then compares the acceleration samples to a calibration vector to determine whether a user has fallen and potentially been injured.

Figure 1:
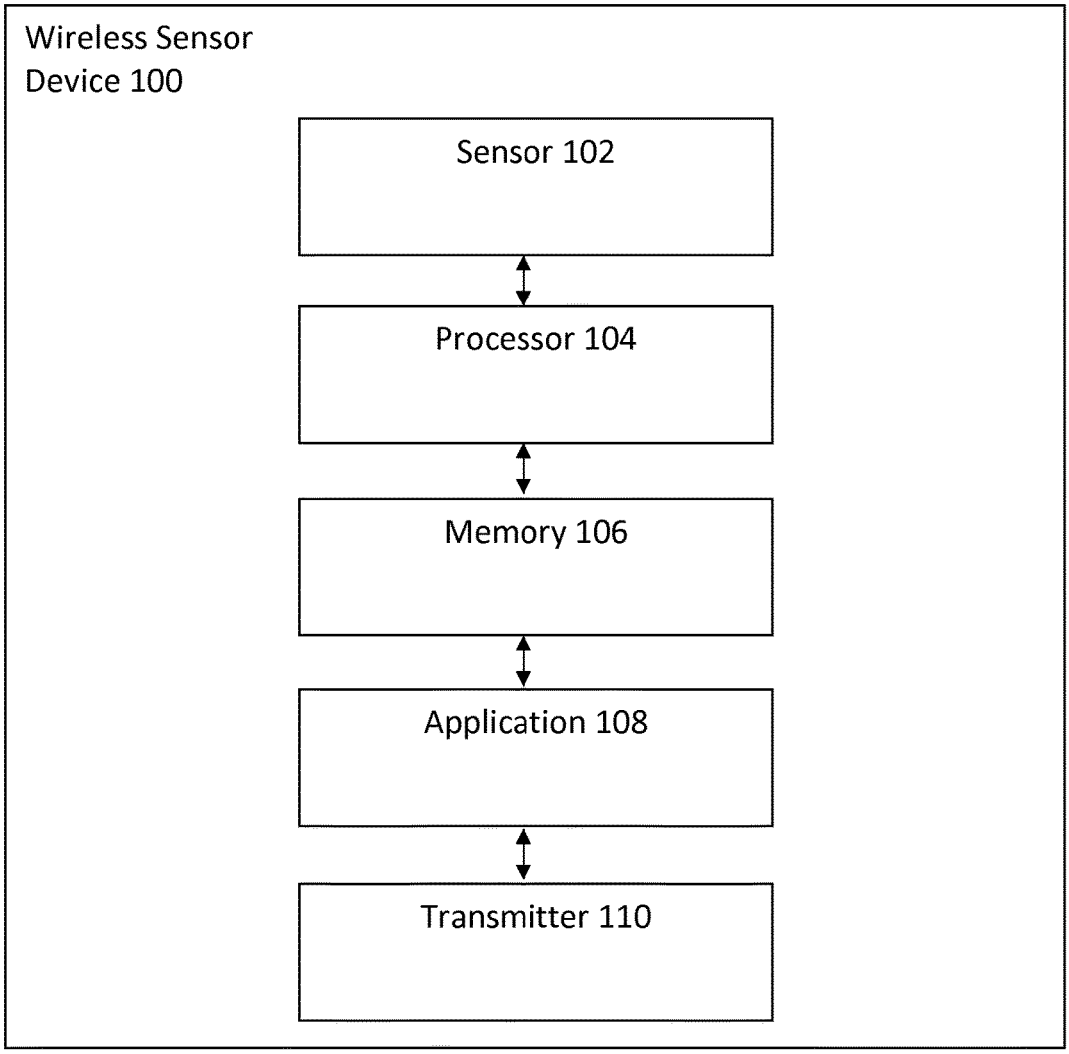
FIG. 1 illustrates a wireless sensor device in accordance with an embodiment.

FIG. 1 illustrates a wireless sensor device 100 in accordance with an embodiment. The wireless sensor device 100 includes a sensor 102, a processor 104 coupled to the sensor 102, a memory 106 coupled to the processor 104, an application 108 coupled to the memory 106, and a transmitter 110 coupled to the application 108. The wireless sensor device 100 is attached, in any orientation, to a user. The sensor 102 obtains data from the user and transmits the data to the memory 106 and in turn to the application 108. The processor 104 executes the application 108 to determine information regarding whether a user has fallen. The information is transmitted to the transmitter 110 and in turn relayed to another user or device.

In one embodiment, the sensor 102 is a microelectromechanical system (MEMS) tri-axial accelerometer and the processor 104 is a microprocessor. One of ordinary skill in the art readily recognizes that the wireless sensor device 100 can utilize a variety of devices for the sensor 102 including but not limited to uni-axial accelerometers, bi-axial accelerometers, gyroscopes, and pressure sensors and that would be within the spirit and scope of the present invention. One of ordinary skill in the art readily recognizes that the wireless sensor device 100 can utilize a variety of devices for the processor 104 including but not limited to controllers and microcontrollers and that would be within the spirit and scope of the present invention. In addition, one of ordinary skill in the art readily recognizes that a variety of devices can be utilized for the memory 106, the application 108, and the transmitter 110 and that would be within the spirit and scope of the present invention.

Figure 2:
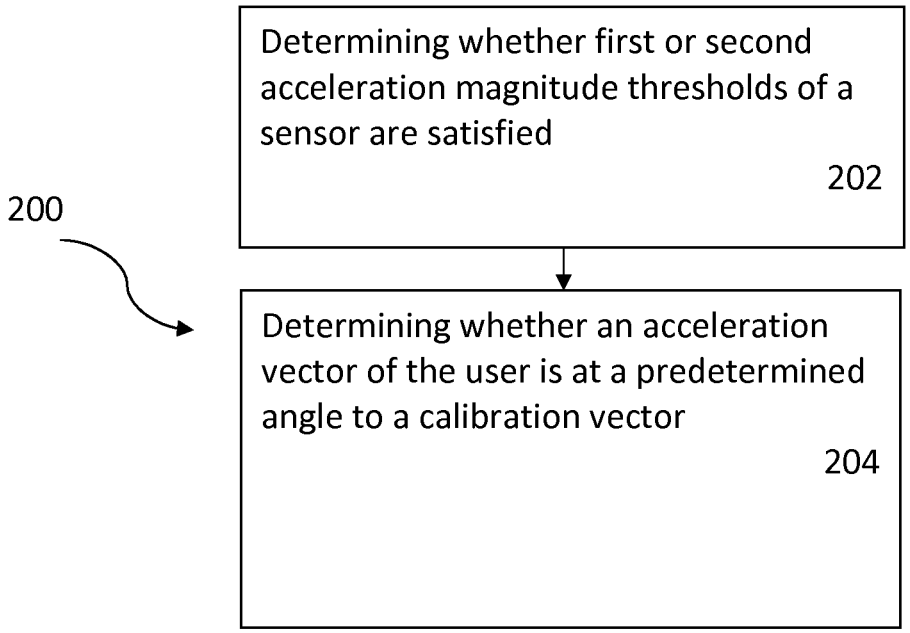
FIG. 2 illustrates a flow chart of a method in accordance with an embodiment.

FIG. 2 illustrates a flow chart of a method 200 in accordance with an embodiment. Referring to FIGS. 1 and 2 together, it is determined whether first or second acceleration magnitude thresholds of the sensor 102 are satisfied, via step 202. The sensor 102 is housed within the wireless sensor device 100. If the first or second acceleration magnitude thresholds of the sensor 102 are satisfied, it is determined whether an acceleration vector of a user of the sensor 102 is at a predetermined angle to a calibration vector, via step 204. One of ordinary skill in the art readily recognizes that a variety of predetermined angles can be utilized including but not limited to a nearly orthogonal angle and that would be within the spirit and scope of the present invention.

In one embodiment, if the first or second acceleration magnitude thresholds of the sensor 102 are satisfied and if the acceleration vector of the user of the sensor 102 is at the predetermined angle to the calibration vector, whether the user lacks movement for a predetermined time period is determined and notification information of the fall detection of the user is relayed to another user or device.

In one embodiment, step 202 includes obtaining an acceleration sample from the user and comparing the acceleration sample to a first acceleration magnitude threshold. In this embodiment, if the acceleration sample is less than the first acceleration magnitude threshold, the first acceleration magnitude threshold of the sensor 102 is satisfied. If not, step 202 further includes comparing the acceleration sample to a second acceleration magnitude threshold. If the acceleration sample is greater than the second acceleration magnitude threshold, the second acceleration magnitude threshold of the sensor 102 is satisfied.

In one embodiment, step 204 includes attaching in any orientation, including but not limited to along the X-axis, Y-axis, and Z-axis, the wireless sensor device 100 to the user and determining the calibration vector. The calibration vector is an acceleration vector when the user is in a vertical position, including but not limited to sitting upright or standing. Once the calibration vector is determined, at least one acceleration sample is obtained from the user using the wireless sensor device 100 and the at least one acceleration sample is compared to the calibration vector. If the at least one acceleration sample is nearly orthogonal to the calibration vector, then the fall of the user is detected.

Figure 3:
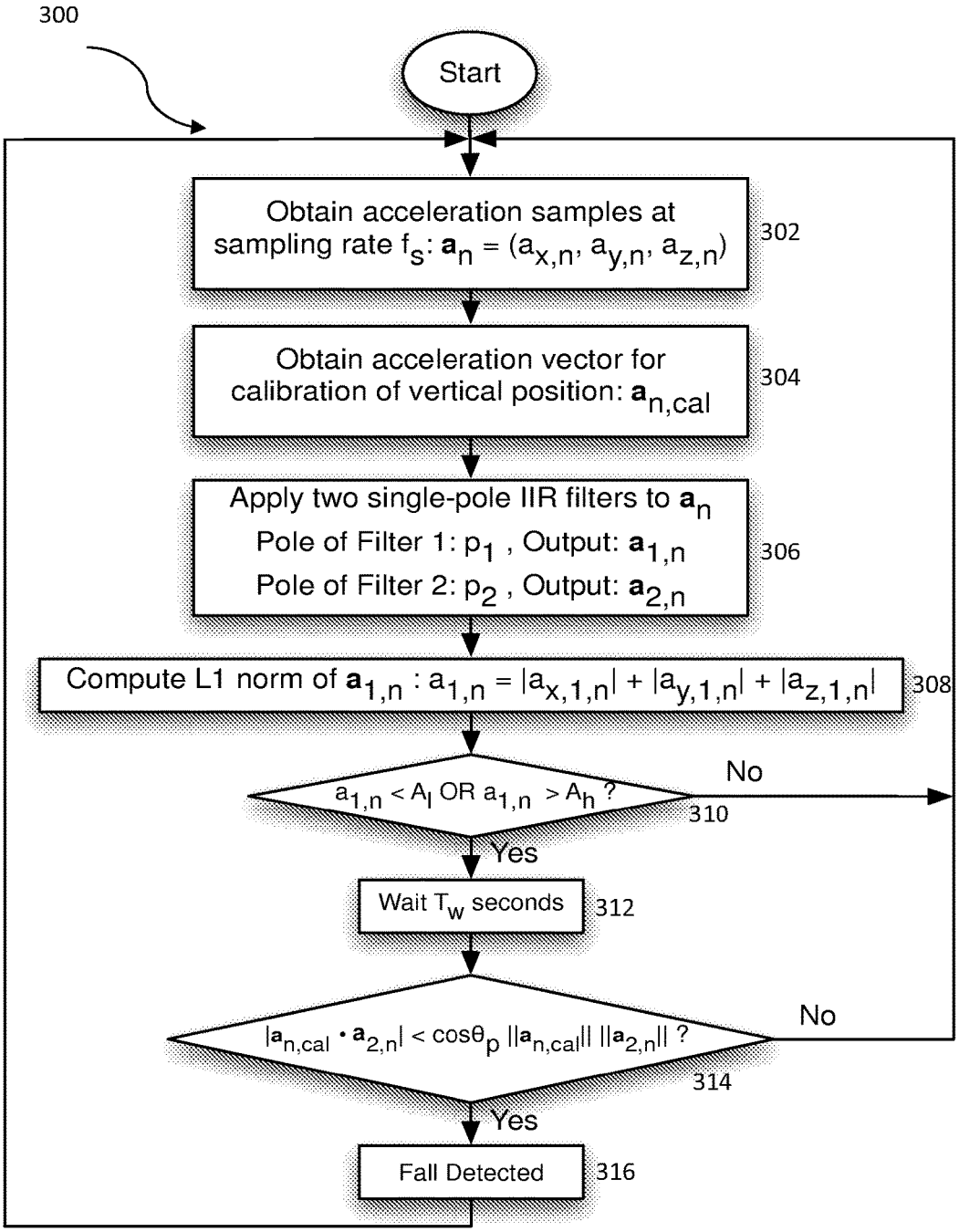
FIG. 3 illustrates a more detailed flow chart of a method in accordance with an embodiment.

FIG. 3 illustrates a more detailed flowchart of a method 300 in accordance with an embodiment. In this embodiment, acceleration samples ($a_n$) are obtained from a user of the wireless sensor device 100 at a sampling rate ($f_s$), via step 302. One of ordinary skill in the art readily recognizes that a variety of acceleration sample ranges can be utilized including but not limited to +−4 gravitational acceleration (g) and that would be within the spirit and scope of the present invention. In addition, one of ordinary skill in the art readily recognizes that a variety of sampling rates ($f_s$) can be utilized including but not limited to 60 Hertz (Hz), 100 Hz, and 500 Hz and that would be within the spirit and scope of the present invention. The acceleration samples ($a_n$) can be represented by the following equation:

$$a_n=(a_{x,n},a_{y,n},a_{z,n}). \tag{1}$$

After obtaining the acceleration samples ($a_n$), an acceleration vector ($a_{n,cal}$) is obtained for the calibration of the vector position, via step 304. The acceleration vector ($a_{n,cal}$) is a calibration vector. One of ordinary skill in the art readily recognizes that a variety of calibration methodologies for obtaining the calibration vector can be utilized and that would be within the spirit and scope of the present invention. In one embodiment, the wireless sensor device 100 is attached when the user is in a vertical position and then an acceleration sample is measured immediately after the attachment. In this embodiment, the measured acceleration sample is determined to be the calibration vector.

In another embodiment, a pedometer type device is integrated into the wireless sensor device 100 to detect user footsteps. After the wireless sensor device 100 is attached to the user in any horizontal or vertical position, including but not limited to laying down or standing, an acceleration sample is measured immediately after the user takes at least one footstep or is walking. In this embodiment, the measured acceleration sample is determined to be the calibration vector.

Two filters are applied to the acceleration sample ($a_n$) to output vector $a_{1,n}$ from the pole of the first filter (filter 1) and to output vector $a_{2,n}$ from the pole of the second filter (filter 2), via step 306. One of ordinary skill in the art readily recognizes that a variety of filters can be utilized for the two filters including but not limited to single-pole infinite impulse response (IIR) filters, multiple-pole IIR filters, finite impulse response (FIR) filters, median filters, high-pass filters and low-pass filters and that would be within the spirit and scope of the present invention. In one embodiment, the first filter (filter 1) is a single-pole infinite impulse response filter that resembles a high-pass filter with a pole of $p_1=1-1/8$ and the second filter (filter 2) is a single-pole infinite impulse response filter that resembles a low-pass filter with a pole of $p_2=1-1/50$.

L1-norm of the output vector $a_{1,n}$ is computed, via step 308, which can be represented by the following equation:

$$a_{1,n}=|a_{x,1,n}|+|a_{y,1,n}|+|a_{z,1,n}|. \tag{2}$$

The L1-norm computation of the output vector $a_{1,n}$ results in a scalar $a_{1,n}$ which is compared to a lower acceleration magnitude threshold ($A_l$) or to a higher acceleration magnitude threshold ($A_h$), via step 310. One of ordinary skill in the art readily recognizes that a variety of Lp-norm computations can be utilized including but not limited to L1-norm, L2-norm, and L∞-norm and that would be within the spirit and scope of the present invention.

In addition, one of ordinary skill in the art readily recognizes that a variety of mathematical calculations can be utilized to convert an output vector into a scalar and that would be within the spirit and scope of the present invention. One of ordinary skill in the art readily recognizes that a variety of acceleration magnitude thresholds can be utilized and that would be within the spirit and scope of the present invention. In one embodiment, the lower acceleration magnitude threshold ($A_l$) is 0.3 g and the higher acceleration magnitude threshold ($A_h$) is 3.5 g.

If the condition in step 310, either $a_{1,n}<A_l$ or $a_{1,n}>A_h$, is satisfied, then a predetermined time period ($T_w$) is waited, via step 312. One of ordinary skill in the art readily recognizes that the predetermined time period may encompass a variety of time periods including but not limited to 2 to 5 seconds and that would be within the spirit and scope of the present invention. If the condition in step 310 is not satisfied, then additional acceleration samples ($a_n$) are obtained, via step 302.

After waiting the predetermined time period ($T_w$), it is determined whether the output vector $a_{2,n}$ is at a predetermined angle ($\square_p$), including but not limited to 60 degrees and a nearly orthogonal angle, to the acceleration vector for calibration of vertical position ($a_{n,cal}$), via step 314. This determination can be represented by the following equation:

$$|a_{n,cal} \cdot a_{2,n}| < \cos \square_p \|a_{n,cal}\| \|a_{2,n}\|. \quad (3)$$

If equation (3) is satisfied, then a user's fall is detected, via step 316 and additional acceleration samples ($a_n$) are obtained, via step 302. If equation (3) is not satisfied, additional acceleration samples ($a_n$) are obtained, via step 302.

Figure 4:
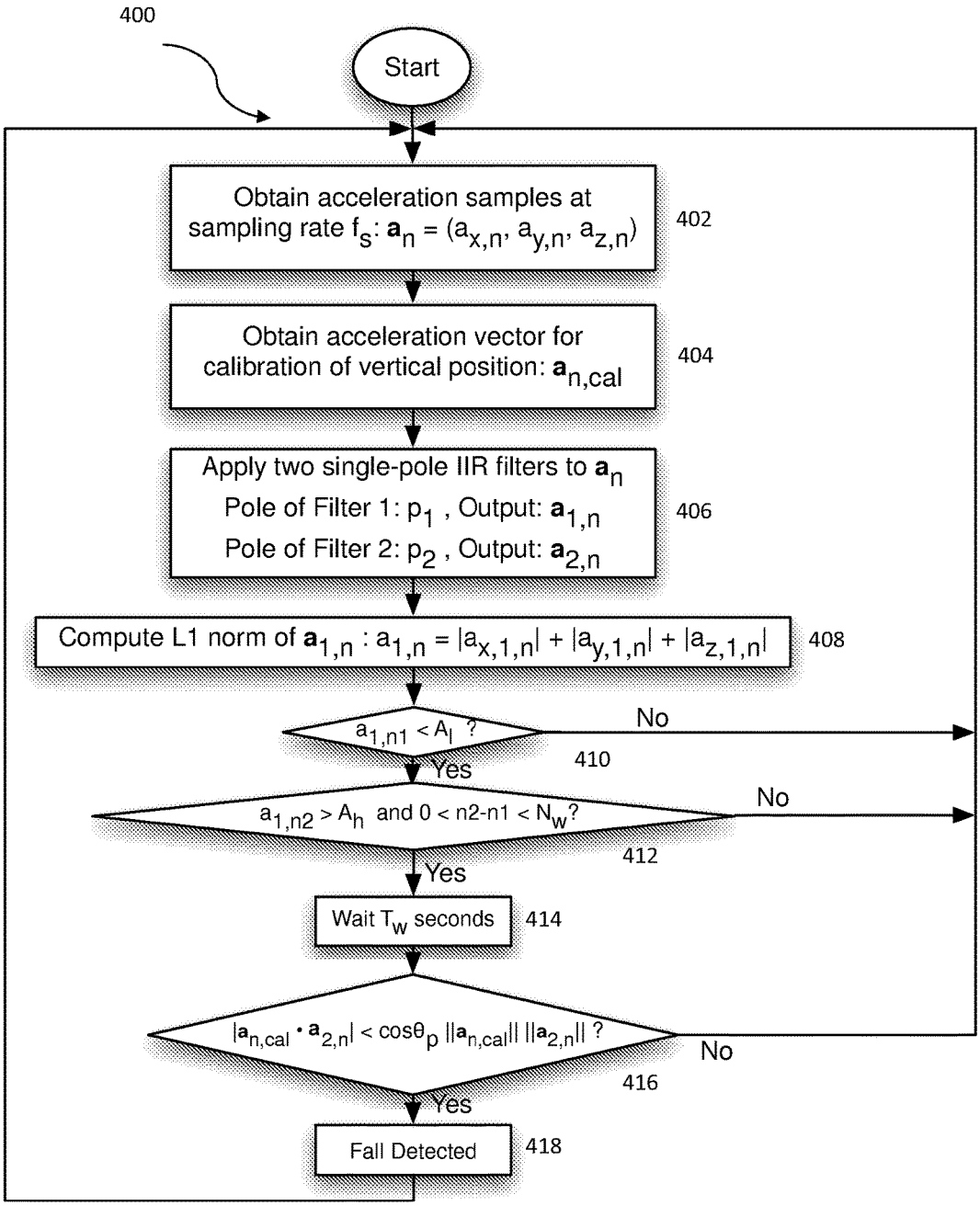
FIG. 4 illustrates a more detailed flow chart of a method in accordance with an embodiment.

In one embodiment, the L1-norm computation of the output vector $a_{1,n}$ that results in a scalar $a_{1,n}$ is compared to both a lower acceleration magnitude threshold ($A_l$) and also to a higher acceleration magnitude threshold ($A_h$). FIG. 4 illustrates a more detailed flowchart of a method 400 in accordance with an embodiment. Referring to FIG. 3 and FIG. 4 together, steps 402-408, which are similar to steps 302-308, are performed. After steps 402-408 are performed, scalar $a_{1,n1}$ is compared to a lower acceleration magnitude threshold ($A_l$), via step 410. If the condition in step 410, $a_{1,n1} < A_l$, is not satisfied, then additional acceleration samples ($a_n$) are obtained, via step 302.

If the condition in step 410 is satisfied, scalar $a_{1,n2}$ is compared to a higher acceleration magnitude threshold ($A_h$) within a predetermined sampling number ($N_w$), via step 412. One of ordinary skill in the art readily recognizes that the predetermined sampling number ($N_w$) could include a varying number of acceleration samples and that would be within the spirit and scope of the present invention. If the condition in step 412, $a_{1,n} > A_h$ and $0 < n2 - n1 < N_w$, is not satisfied, then additional acceleration samples ($a_n$) are obtained, via step 302. Referring to FIG. 3 and FIG. 4 together, if the condition in step 412 is satisfied, steps 414-418, which are similar to steps 312-316, are performed.

As above described, the method and system allow for fall detection of a user that discriminates problematic falls from activities of daily living, including but not limited to falling onto a couch to take a nap. Additionally, the fall detection can be done without regard to the attachment orientation of the wireless sensor device to the user. By implementing a tri-axial accelerometer within a wireless sensor device to detect acceleration samples and an application located on the wireless sensor device to process the detected acceleration samples, an efficient and cost-effective fall detection system is achieved that can support various types of falls and can confirm that the user is in a horizontal position.

A method and system for fall detection of a user have been disclosed. Embodiments described herein can take the form of an entirely hardware implementation, an entirely software implementation, or an implementation containing both hardware and software elements. Embodiments may be implemented in software, which includes, but is not limited to, application software, firmware, resident software, microcode, etc.

The steps described herein may be implemented using any suitable controller or processor, and software application, which may be stored on any suitable storage location or computer-readable medium. The software application provides instructions that enable the processor to cause the receiver to perform the functions described herein.

Furthermore, embodiments may take the form of a computer program product accessible from a computer-usable or computer-readable medium providing program code for use by or in connection with a computer or any instruction execution system. For the purposes of this description, a computer-usable or computer-readable medium can be any apparatus that can contain, store, communicate, propagate, or transport the program for use by or in connection with the instruction execution system, apparatus, or device.

The medium may be an electronic, magnetic, optical, electromagnetic, infrared, semiconductor system (or apparatus or device), or a propagation medium. Examples of a computer-readable medium include a semiconductor or solid state memory, magnetic tape, a removable computer diskette, a random access memory (RAM), a read-only memory (ROM), a rigid magnetic disk, and an optical disk. Current examples of optical disks include DVD, compact disk-read-only memory (CD-ROM), and compact disk-read/write (CD-RAN).

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A method for fall detection of a user, the method comprising:

determining a calibration vector as an acceleration sample detected when the user is walking using a pedometer device of a wireless sensor device attached to the user, wherein the calibration vector is a first acceleration vector;

determining whether a first magnitude threshold is satisfied using the first acceleration vector or whether a second magnitude threshold is satisfied using the first acceleration vector, wherein the first magnitude threshold is lower than the second magnitude threshold;

wherein if either the first magnitude threshold or the second magnitude threshold is satisfied, determining whether a second acceleration vector of the user is nearly orthogonal to the calibration vector using a cosine function;

wherein if the second acceleration vector is nearly orthogonal to the calibration vector, detecting the fall of the user;

wherein determining whether first or second magnitude thresholds are satisfied further comprises:

obtaining an acceleration sample from the user;

comparing the acceleration sample to a first acceleration threshold;

wherein comparing the acceleration sample to the first acceleration threshold further comprises:

applying two filters to the acceleration sample to output an acceleration vector; and wherein the two filters comprise single-pole infinite impulse response (IIR) filters and multiple-pole IIR filters.

2. The method of claim 1, wherein determining whether first or second magnitude thresholds are satisfied further comprises:

wherein if the acceleration sample is less than the first acceleration threshold, the first magnitude threshold is satisfied, else comparing the acceleration sample to a second acceleration threshold; and wherein if the acceleration sample is greater than the second acceleration threshold, the second magnitude threshold is satisfied.

3. The method of claim 2, wherein comparing the acceleration sample to the first acceleration threshold further comprises:

calculating Lp-norm of the acceleration vector to output an acceleration scalar; and comparing the acceleration scalar to the first acceleration threshold.

4. The method of claim 2, wherein comparing the acceleration sample to the second acceleration threshold further comprises:

applying two filters to the acceleration sample to output an acceleration vector;

calculating Lp-norm of the acceleration vector to output an acceleration scalar; and comparing the acceleration scalar to the second acceleration threshold.

5. The method of claim 3, wherein Lp-norm is any of L1-norm, L2-norm, L∞-norm.

6. The method of claim 4, wherein Lp-norm is any of L1-norm, L2-norm, L∞-norm and the two filters are any of single-pole infinite impulse response (IIR) filters, multiple-pole IIR filters, finite impulse response (FIR) filters and median filters.

7. The method of claim 1, wherein determining the calibration vector further comprises:

attaching a wireless sensor device when the user is vertical; and measuring an acceleration sample after attachment, wherein the acceleration sample is determined to be the calibration vector.

8. The method of claim 1, wherein determining the calibration vector further comprises:

measuring an acceleration sample after the user is walking, wherein the acceleration sample is determined to be the calibration vector.

9. The method of claim 1, further comprising:

wherein if the first or second magnitude thresholds are satisfied, waiting a predetermined time period before determining whether the second acceleration vector of the user is at a predetermined angle to the calibration vector.

10. The method of claim 1, further comprising:

wherein if the first or second magnitude thresholds are satisfied and if the second acceleration vector of the user is nearly orthogonal to the calibration vector, determining if the user lacks movement for a predetermined time period; and relaying notification information of the fall detection of the user to another user or device.

11. The method of claim 1, further comprising:

determining whether both the first and the second magnitude thresholds are satisfied; and wherein if the first and second magnitude thresholds are satisfied, determining whether the second acceleration vector of the user is at a predetermined angle to a calibration vector.

12. The method of claim 11, wherein determining whether first and second magnitude thresholds are satisfied further comprises:

obtaining a first acceleration sample from the user;

comparing the first acceleration sample to a first acceleration threshold;

wherein if the first acceleration sample is less than the first acceleration threshold, obtaining a second acceleration sample from the user within a predetermined sampling period;

comparing the second acceleration sample to a second acceleration threshold; and wherein if the second acceleration sample is greater than the second acceleration threshold, the first and second magnitude thresholds are satisfied.

13. A wireless sensor device for fall detection of a user, the wireless sensor device comprising:

a processor; and an application, wherein the application, when executed by the processor, causes the processor to:

determine a calibration vector as an acceleration sample detected when the user is walking using a pedometer device of a wireless sensor device attached to the user, wherein the calibration vector is a first acceleration vector;

determine whether a first magnitude threshold is satisfied using the first acceleration vector or whether a second magnitude threshold is satisfied using the first acceleration vector, wherein the first magnitude threshold is lower than the second magnitude threshold;

in response to either the first magnitude threshold or the second magnitude threshold being satisfied, determine whether a second acceleration vector of the user is nearly orthogonal to the calibration vector using a cosine function;

in response to the second acceleration vector being nearly orthogonal to the calibration vector, detect the fall of the user obtain an acceleration sample from the user;

compare the acceleration sample to a first acceleration threshold; and apply two filters to the acceleration sample to output an acceleration vector, wherein the two filters comprise single-pole infinite impulse response (IIR) filters and multiple-pole IIR filters.

14. The wireless sensor device of claim 13, wherein the application, when executed by the processor, further causes the processor to:

wherein if the acceleration sample is less than the first acceleration threshold, the first magnitude threshold is satisfied, else the application compares the acceleration sample to a second acceleration threshold; and wherein if the acceleration sample is greater than the second acceleration threshold, the second magnitude threshold is satisfied.

15. The wireless sensor device of claim 14, wherein the application, when executed by the processor, further causes the processor to:

calculate Lp-norm of the acceleration vector to output an acceleration scalar; and compare the acceleration scalar to the first acceleration threshold or to the second acceleration threshold.

16. The wireless sensor device of claim 15, wherein Lp-norm is any of L1-norm, L2-norm, L∞-norm.

17. The wireless sensor device of claim 13, wherein if the first or second magnitude thresholds are satisfied and if the second acceleration vector of the user is at a predetermined angle to the calibration vector, wherein the application, when executed by the processor, further causes the processor to:

determine if the user lacks movement for a predetermined time period; and relay notification information of the fall detection of the user to another user or device.

* * * * *